US007931228B2

(12) United States Patent
Omdoll

(10) Patent No.: US 7,931,228 B2
(45) Date of Patent: Apr. 26, 2011

(54) DISPENSER FOR SHEET MATERIAL

(75) Inventor: Paul Omdoll, Waukesha, WI (US)

(73) Assignee: The Colman Group, Inc., Elkhorn, WI (US)

( * ) Notice: Subject to any disclaimer, the term of this patent is extended or adjusted under 35 U.S.C. 154(b) by 147 days.

(21) Appl. No.: 11/813,144

(22) PCT Filed: Dec. 30, 2005

(86) PCT No.: PCT/US2005/047484

§ 371 (c)(1),
(2), (4) Date: Nov. 12, 2007

(87) PCT Pub. No.: WO2006/072006

PCT Pub. Date: Jul. 6, 2006

(65) Prior Publication Data

US 2008/0190982 A1 Aug. 14, 2008

(51) Int. Cl.
*B65H 43/00* (2006.01)

(52) U.S. Cl. ..... 242/563; 242/564.1

(58) Field of Classification Search ..... 242/559.2, 242/560.1, 563, 590, 596, 564, 564.1, 564.4
See application file for complete search history.

(56) References Cited

U.S. PATENT DOCUMENTS 4,377,808 A * 3/1983 Kao ..... 340/527
4,666,099 A 5/1987 Hoffman et al.
4,721,265 A 1/1988 Hawkins
4,786,005 A 11/1988 Hoffman et al.
4,790,490 A 12/1988 Chakravorty
4,796,825 A 1/1989 Hawkins
4,826,262 A 5/1989 Hartman et al.
4,960,248 A * 10/1990 Bauer et al. ..... 242/564.4
5,086,526 A 2/1992 Van Marcke
5,452,832 A * 9/1995 Niada ..... 242/564.4
5,694,653 A 12/1997 Harald
5,727,579 A 3/1998 Chardack
5,772,291 A * 6/1998 Byrd et al. ..... 312/34.22
5,924,617 A 7/1999 LaCount et al.
5,963,135 A 10/1999 Van Marcke
(Continued)

FOREIGN PATENT DOCUMENTS

CA 2198956 1/1998
(Continued)

OTHER PUBLICATIONS

Written Opinion of the International Search Report (Application No. PCT/US05/47484), May 7, 2007.

*Primary Examiner* — William A Rivera
(74) *Attorney, Agent, or Firm* — Boyle Fredrickson, S.C.

(57) ABSTRACT

The present invention is a dispenser that, in one embodiment, includes a support for a roll of web material, a drive roller cooperating with an idler roller to feed web material supported by the roll support, and a mouth through which the web material is dispensed which has a floor but not a roof such that the web material does not jam when dispensed through the mouth. In another embodiment, the mouth is slot shaped. In various embodiments of the invention with either a slot shaped mouth or a wide mouth without a roof, a sensor is provided for selectively activating a drive motor in response to an incursion into a sensing field, wherein the sensor comprises an infrared emitter and receiver.

38 Claims, 15 Drawing Sheets

U.S. PATENT DOCUMENTS 5,979,821 A 11/1999 LaCount et al.
6,032,898 A 3/2000 LaCount et al.
6,069,354 A * 5/2000 Alfano et al. ..... 312/34.8
6,105,898 A 8/2000 Byrd et al.
6,152,397 A * 11/2000 Purcell ..... 242/560.1
6,250,530 B1 6/2001 LaCount et al.
6,279,777 B1 8/2001 Goodin et al.
6,293,486 B1 9/2001 Byrd et al.
6,388,609 B2 5/2002 Paese et al.
6,390,410 B1 5/2002 LaCount et al.
6,412,655 B1 7/2002 Stuetzel et al.
6,412,679 B2 7/2002 Formon et al.
6,446,901 B1 9/2002 Haen et al.
6,460,798 B1 10/2002 Haen et al.
6,592,067 B2 7/2003 Denen et al.
6,695,246 B1 2/2004 Elliott et al.
6,731,209 B2 5/2004 Wadlow et al.
6,736,348 B1 5/2004 Formon et al.
6,745,927 B2 6/2004 Formon et al.
6,820,785 B2 11/2004 Kapiloff
6,838,887 B2 1/2005 Denen et al.
6,854,684 B2 2/2005 Byrd et al.
6,892,620 B2 5/2005 Kapiloff
6,903,654 B2 6/2005 Hansen et al.
6,953,171 B2 10/2005 Takashima
6,977,588 B2 12/2005 Schotz et al.
6,988,689 B2 1/2006 Thomas et al.
7,044,421 B1 * 5/2006 Omdoll et al. ..... 242/564.4
7,325,767 B2 2/2008 Elliott et al.
7,325,768 B2 2/2008 Byrd et al.
7,354,015 B2 4/2008 Byrd et al.
7,387,274 B2 * 6/2008 Moody et al. ..... 242/564.4
7,398,944 B2 7/2008 Lewis et al.
2001/0017309 A1 8/2001 Formon et al.
2002/0109035 A1 8/2002 Denen et al.
2002/0109036 A1 8/2002 Denen et al.
2003/0041716 A1 3/2003 Takashima
2003/0167893 A1 9/2003 Morris et al.
2004/0178297 A1 * 9/2004 Moody et al. ..... 242/564.4
2005/0127232 A1 * 6/2005 Moody et al. ..... 242/564.4
2005/0224489 A1 10/2005 Matiash
2008/0099595 A1 * 5/2008 Lewis et al. ..... 242/560

FOREIGN PATENT DOCUMENTS

WO WO 2006/072006 6/2006

* cited by examiner 105
103
101

105
FLOOR (LOW MOUNTING)
FLOOR (HIGH MOUNTING)
36
50

DISPENSER FOR SHEET MATERIAL

FIELD OF THE INVENTION

This invention relates generally to dispensers for dispensing sheet material. More particularly, this invention relates to an improved automatic dispenser for dispensing paper towels.

BACKGROUND OF THE INVENTION

Dispensers for rolls of flexible sheet material, such as paper toweling, have been employed for a great many years. Dispensers are widely used in public lavatories to dispense paper toweling for users to dry their hands. Typically, a roll of sheet material is rotatably supported inside the dispenser cabinet. A user actuates a crank or lever that drives a feed mechanism for dispensing the sheet material. The feed mechanism typically includes a drive roller and an idle roller (or pinch roller). The crank or lever interacts with the drive roller so that actuation of the crank or lever rotates the drive roller. Rotation of the drive roller acts to unwind the sheet material roll. The crank or lever is usually a separate mechanism from the housing of the roll dispenser.

Recently, in order to provide more sanitary conditions and to improve the ease with which roll towel dispensers are used, "hands free" or "touchless" dispensers have been developed. Examples of such dispensers can be seen in U.S. Pat. Nos. 6,820,785, 6,745,927, and 5,772,291. These dispensers eliminate the manually operated crank or lever drive systems in favor of electrically operated drive systems that feed paper with minimal user effort.

In one form, hands free dispensers require a user to wave a hand (or other body part) in front of a sensor mounted in the front of the dispenser. In such constructions, a sensor is generally on or behind the dispenser's front cover. This approach makes the dispenser susceptible to accidental triggering and requires a user to first waive his or her wet hand, then move that or the other hand to the mouth of the dispenser to receive the paper as it's dispensed.

Another form of hands free dispenser starts with a length of paper extending from the dispenser. When the paper is tensioned or a length torn off, the dispenser automatically feeds another length. From a purely ergonomic point of view, this approach is more effective since a user need do nothing other than tear off the previously presented length of paper. However, this approach can be perceived as less sanitary since the length of paper extending from the dispenser prior to use is exposed to the environment for some period of time.

One of the problems with many conventional dispensers is that their configurations permit a user to cause the dispenser to "freewheel" or "free pull" such that an unlimited amount of paper can be pulled. Free pulling is made possible by the angular relationship between the dispenser mouth, the drive and idler roller and the cutting blade. More specifically, where the paper can be pulled in a straight line without contacting the cutting bar, free pulling is possible.

Another problem with conventional dispensers is that paper can jam in the mouth. This can be caused by one or more of a variety of factors including the weight of the paper, the curl of the paper, humidity, ragged edges and static electricity. In general, the narrower the mouth, the greater the likelihood of jamming. On the other hand, if the mouth is made too wide, the ability to free pull increases.

As a general rule, roll sheet material dispensers feed paper downwardly from the bottom of their housings through wide mouths. Some feed the paper straight down while others feed the paper somewhat outwardly as well as down. Depending on the height and placement of the dispenser, this feeding approach actually places the paper in a position that is less than optimal for a user to grasp it, particularly after waving a hand in front of the dispenser's housing. Moreover, the height and width of the mouth of most dispensers is such that when the paper is torn, the edge can get ragged resulting in paper jams and unsightly presentation. This is because there is very little, if any, limitation on the tearing angle that a user can employ to tear off a length of paper and because the size and shape of the mouth causes the ragged edge to catch and twist or fold up on itself. This may also be attributed to safety concerns that limit the sharpness of the blade that can be used. Because the size of the mouth of most dispensers is such that a user's fingers could fit within the housing and contact the blade, its sharpness must be limited.

Accordingly, a need exists for a sheet material dispenser that overcomes some or all of the disadvantages set forth above and provides an improvement over prior art dispensers.

SUMMARY OF THE INVENTION

In one embodiment of the present invention, the mouth of a sheet material dispenser is constructed so that the roof of the mouth is essentially eliminated, bringing the dispensing area back to adjacent the point at which the sheet material exits from between the drive roller and idler roller (the "pinch point"). This mouth construction precludes jamming since the paper is available for user access immediately upon exiting from the pinch point. Moreover, since the mouth still retains its floor structure, and since the cutting blade (and trigger arm if the dispenser is an automatic dispenser without a sensor) is positioned so that any outward or upward pull on the paper results in the paper tearing or additional paper being fed in a predetermined manner. No free pulling is possible.

In another embodiment of the present invention a sheet material dispenser is provided that completely changes the paradigm for the presentment of roll sheet material to a user. It does so by providing a "slot mouth" construction that allows dispensed paper to emerge from the dispenser housing upwardly or outwardly, before it moves downwardly.

As noted above, in traditional roll sheet material dispensers, one component of the initial delivery of a sheet material is virtually always down. This embodiment of the present invention alters that convention by essentially "offering" the sheet material to a user by pushing it first upwardly or outwardly before it moves down. This makes a length of sheet material much easier to grasp and is consistent with a more "user-friendly" approach that actually puts the sheet material in a user's hands.

The slot mouth also provides a number of additional advantages. First, because of its visual appearance in the front of the dispenser, the slot mouth provides a user with a visual cue as to where and how to reach for sheet material. Still further, by virtue of its narrow size, the slot mouth "guides" the sheet material from the drive rollers through the slot thereby decreasing the likelihood that the sheet material will roll over on itself and cause a jam. The size of the slot mouth also precludes the possibility of a user using his or her fingers to contact the drive rollers or the cutting blade. As a result, the ability for users to cause jams is reduced because they cannot interfere with the feeding of the sheet material as it leaves the drive rollers. The cutting blade can also be made sharper without fear of user injury, thereby minimizing the possibility of incomplete or uneven tearing of the sheet material and further reducing the chance of jamming. The integrity of the tear is further enhanced because the slot mouth construction effectively limits the angle that the sheet material can take vis-à-vis the cutting bar. More particularly, in order to separate a length of sheet material from the roll, a user must pull the sheet material within a very narrow angular range, relative to the dispenser and/or the cutting bar. For the same reasons, the slot mouth prevents the possibility of a user achieving free pul". Such action is stopped because there is no way to achieve an angular relationship that would result in free pull without contacting the cutting blade and tearing the sheet material. The avoidance of free pull has a marked impact on the overall consumption of paper because only appropriately measured amounts are dispensed.

The present invention also preferably comprises a sensor that is constructed to minimize power consumption, false triggering, unit cost and is adjustable to achieve various user needs. The present invention preferably provides a means by which the feeding of sheet material can be triggered in a manner consistent with a user's natural tendencies to acquire sheet material from a dispenser. While such a sensor has certain advantages when coupled with the mouth designs of the present invention, it also provides numerous advantages when used in conjunction with more conventional dispensers.

DESCRIPTION OF THE DRAWINGS

FIG. 10 is a front view of a detector and emitter pattern and their area of convergence in a simplified two dimensional form;

FIG. 11 is side view of the detector and emitter pattern and their area of convergence as shown in FIG. 10;

DETAILED DESCRIPTION OF THE PREFERRED EMBODIMENTS

Figure 1:
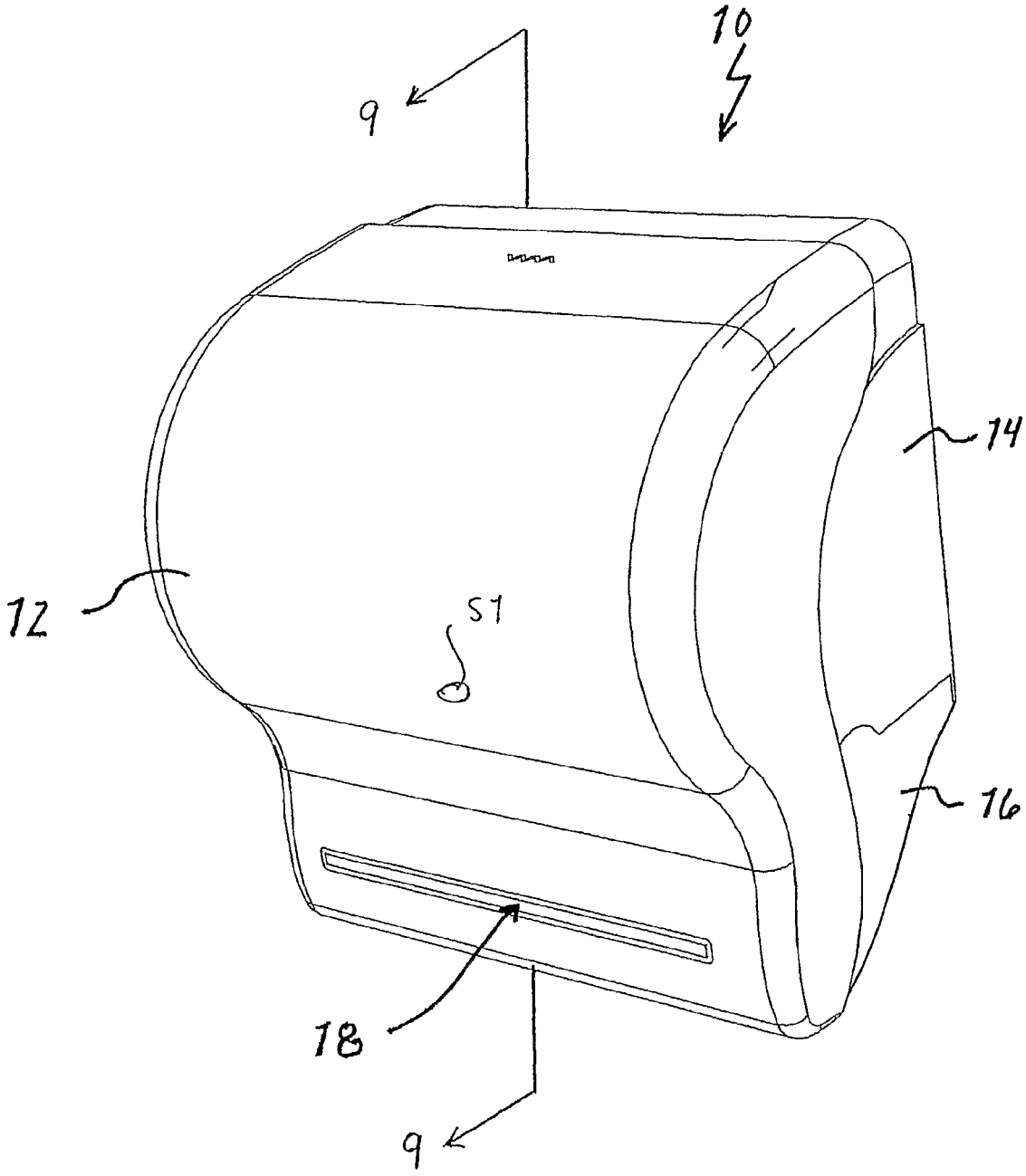
FIG. 1 is a left side-top-front perspective view of one embodiment of the present invention.

As shown in FIG. 1, the present invention relates to a dispenser 10 having a front cover 12, a rear housing 14, a gear box cover 16 and a slot shaped mouth 18 ("slot mouth"). The front cover 12, rear housing 14 and gear box cover 16 define the overall housing of the dispenser 10 within which a roll of sheet material and the working components of the dispenser 10 are contained. Preferably the volume occupied by the dispenser 10 is minimized by contouring the front cover 12 to follow the width and breadth of the maximum size of a roll of sheet material supportable by the dispenser and by strategically locating the working components of the dispenser within the housing below the roll of sheet material (not shown).

Figure 2:
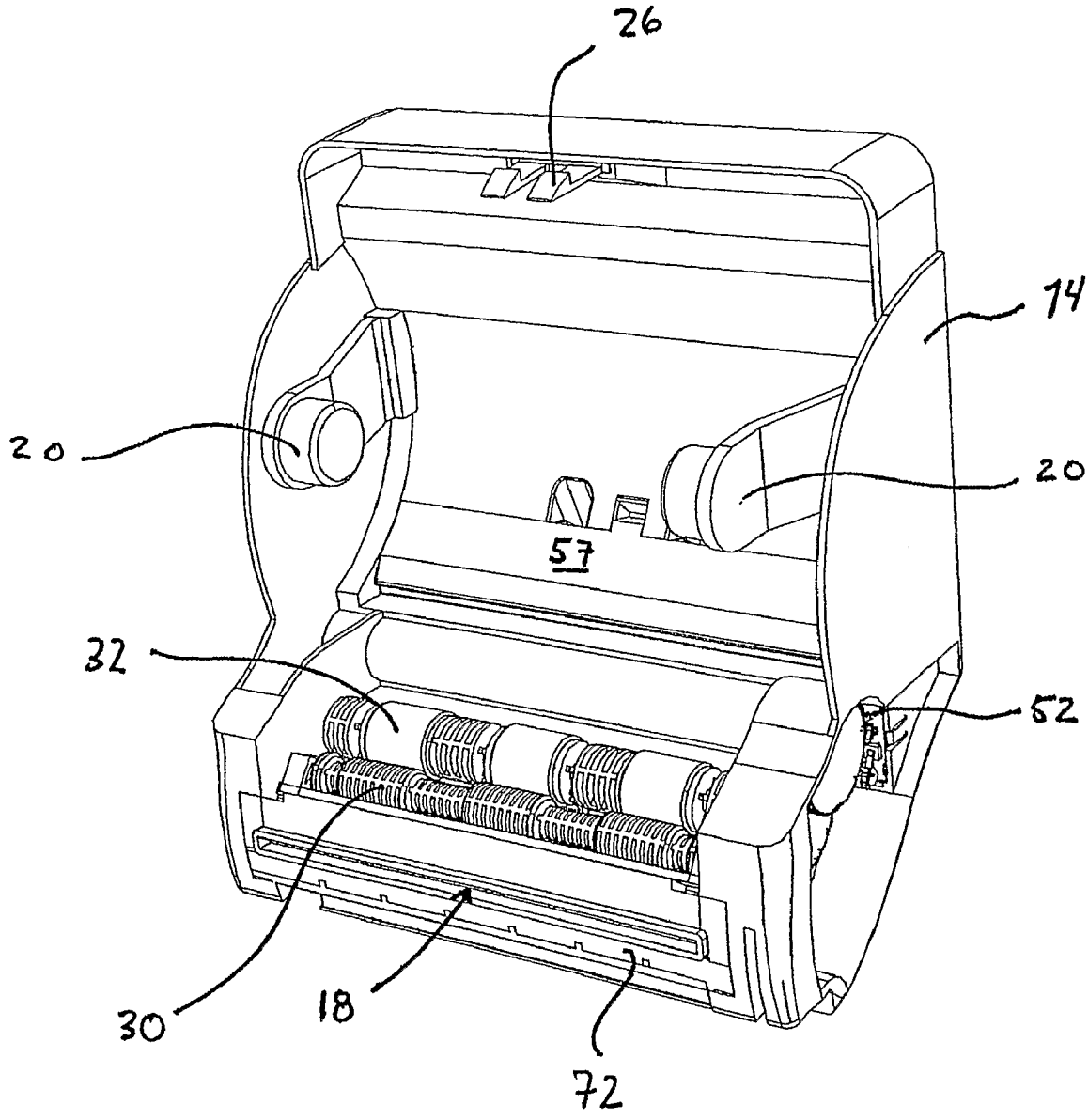
FIG. 2 is a perspective view of the embodiment of FIG. 1 with the front cover and gear box cover removed.
Figure 6:
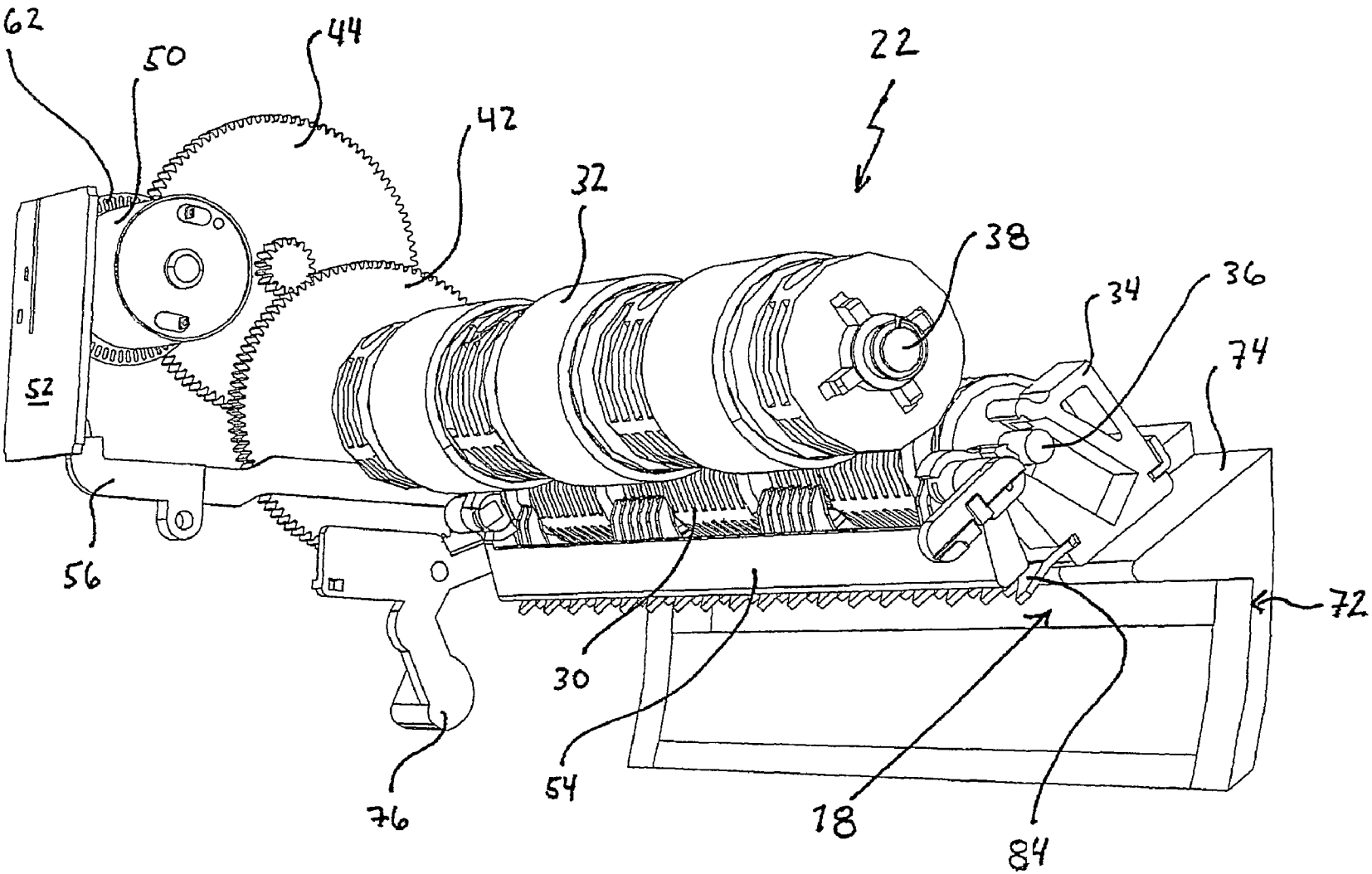
FIG. 6 is a right side-rear perspective view of one embodiment of a drive module of the present invention.
Figure 7:
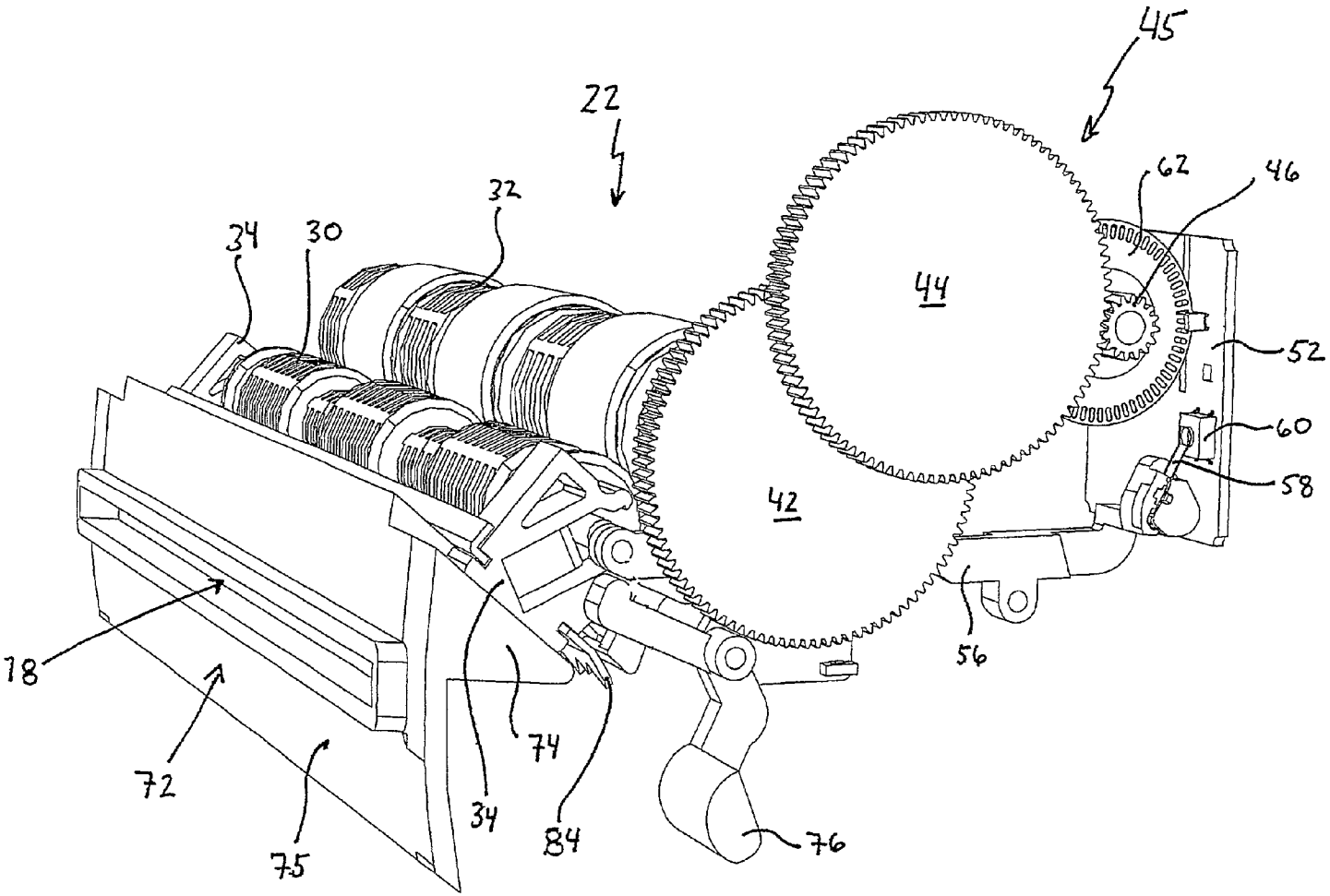
FIG. 7 is a left side-front perspective view of the drive module of FIG. 6.
Figure 8:
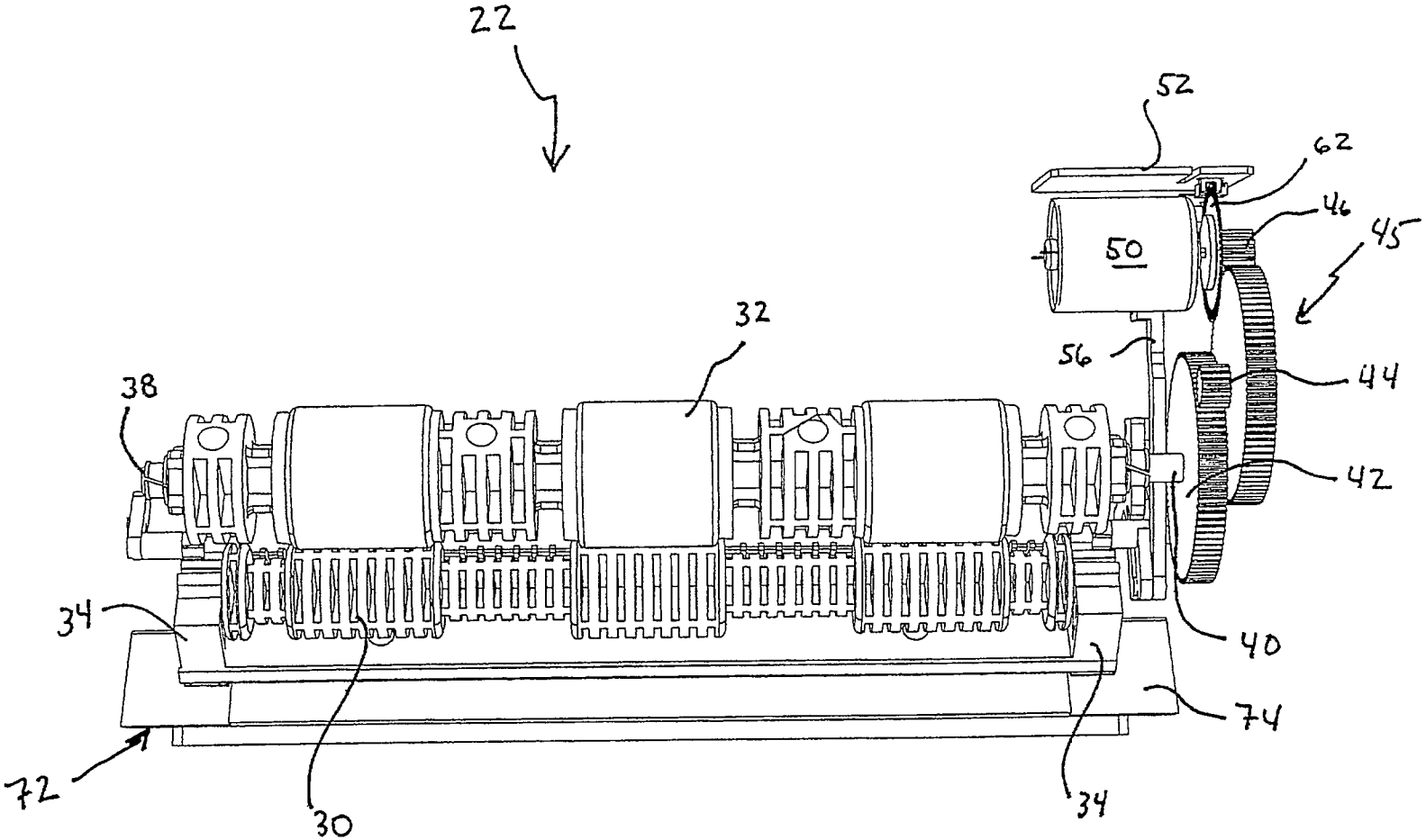
FIG. 8 is a top perspective view of the drive module of FIG. 6.

As shown in FIG. 2, the present invention further comprises a pair of preferably removable roll support arms 20 mounted to the inside of the rear housing 14 for supporting a roll of paper (not shown). Also situated within the housing and ultimately mounted to the rear housing 14, below the support arms 20 (and any mounted roll of paper), is a drive module 22 (see FIGS. 6 and 7). The drive module 22 contains all of the elements involved in the feeding and cutting of the paper. A latch mechanism 24 comprised of two parts, fingers 26 and receiver 28, is also provided to lock the front cover 12 to the rear housing 14.

The drive module 22 comprises an idler roller 30 and a drive roller 32 that, by virtue of their interaction, are capable of selectively advancing sheet material from a roll mounted on support arms 20. The idler roller 30 is mounted between a pair of bearing blocks 34 which rotatably support posts 36 that extend from either side of the idler roller 30. Inside the bearing blocks 34 are springs (not shown) that bias the idler roller 30 to maintain contact with the drive roller 32. The drive roller 32 also has support posts 38 and 40 that extend from its right and left ends, respectively, that are journaled into interior walls of the rear housing 14. Mounted on the end of post 40 of the drive roller 32 is a main drive gear 42. This gear is part of a gear assembly 45 that is used to automatically drive the drive roller 32 and thereby feed sheets of paper. Interacting with main driver gear 42 is a cluster gear 44 that also interacts with an encoder gear 46. The encoder gear 46 is mounted on a shaft 48 that is driven by a motor 50 that selectively supplies the force necessary to turn the drive roller 32.

The motor 50 is driven in accordance with signals conveyed to it from a circuit board 52. Incorporated onto circuit board 52 is some form of controller capable of sending and receiving different signals. One such signal is conveyed to the circuit board by the movement of trigger arm 54 which is rotatably mounted in bearing blocks 34. As trigger arm 54 is moved from a first position to a second position, coincident with the tensioning of paper by a user, trip lever 56 is moved. This, in turn, results in the tensioning of leaf spring 58 that activates switch 60 on the circuit board 52. When trigger arm 54 returns to its first position, the switch 60 is opened and the motor 50 is given a signal to rotate an amount sufficient to feed a predetermined length of sheet material. This predetermined length can be based on a predetermined number of revolutions of the motor shaft, or by using an encoder 62 to measure the length fed in real time.

Figure 5:
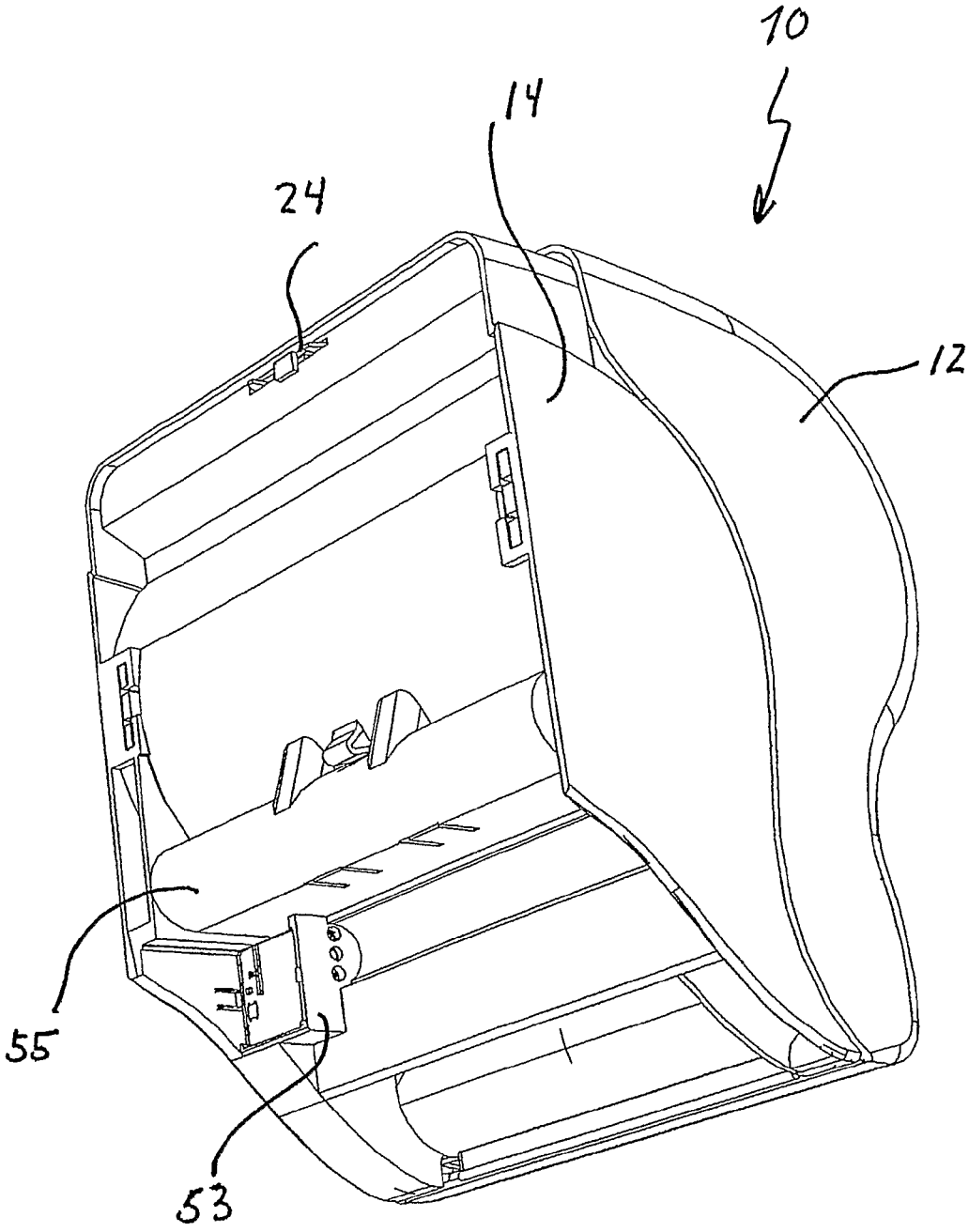
FIG. 5 is a right side-bottom-rear perspective view the embodiment of FIG. 1.

As shown in FIG. 5, the circuit board 52 and motor 50 are both preferably mounted in the rear housing 14 in an appropriately configured recess 53. Similarly, batteries (not shown) that provide the power for the drive motor and controller may be mounted in a battery compartment recess 55 in the rear housing 14 and locked in place with a battery cover 57. Preferably the battery compartment includes at least one battery interlock mechanism that prevents the batteries from being mounted incorrectly, i.e., with their polarity reversed. More particularly, structure can be placed proximate the positive and/or negative terminal(s) to preclude the negative or positive pole of a battery (as appropriate) from touching the wrong terminal. Alternatively, the interlock mechanism can include structure that precludes the battery cover 57 from closing if the polarity of the batteries is reversed.

In additional embodiments of the present invention, the power supply for the drive motor and controller can be in the form of a self perpetuating source such as solar cells or static discharge collector. This source can be instead of or supplemental to batteries.

Figure 3:
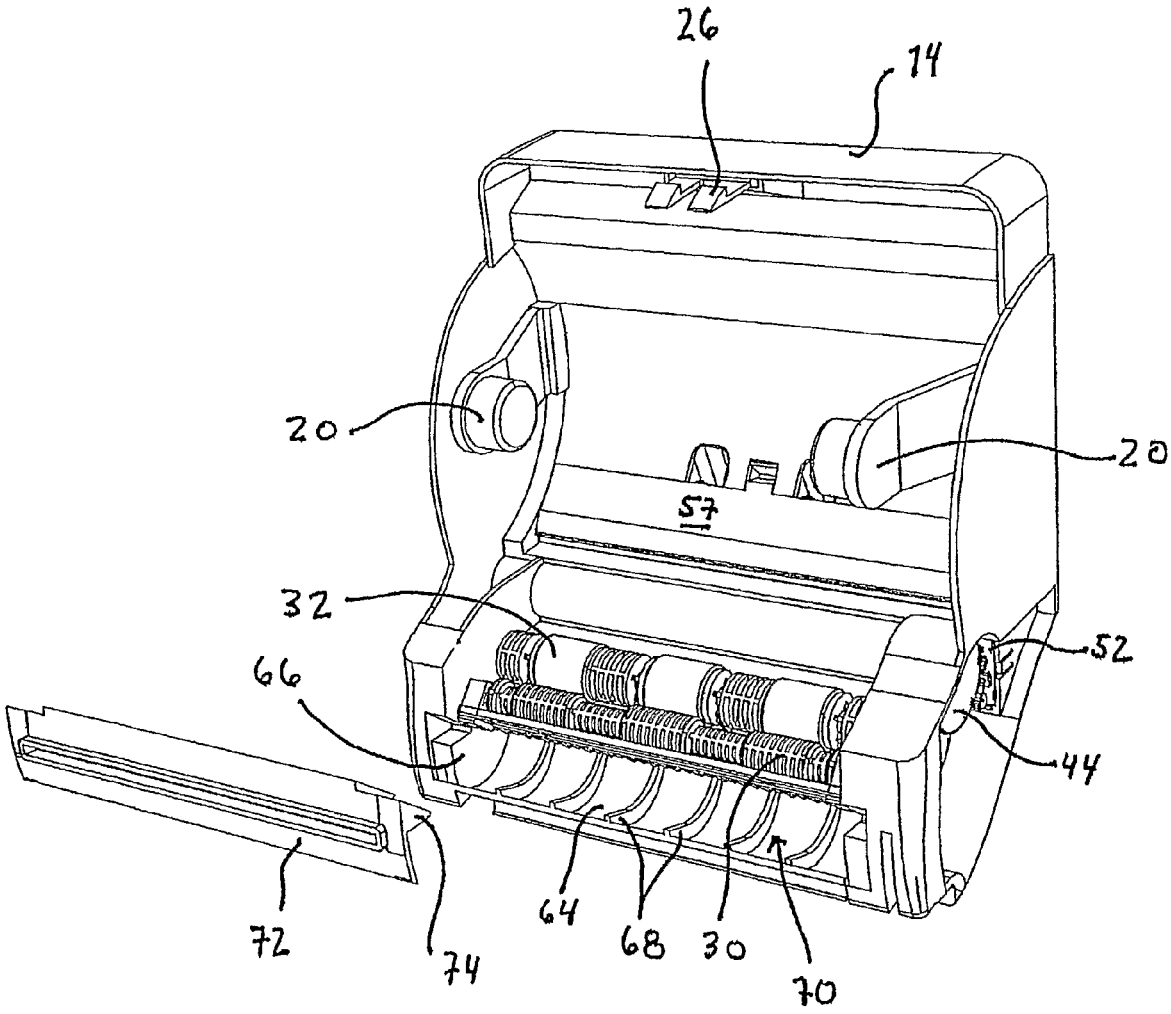
FIG. 3 is a perspective partially exploded view of the embodiment of FIG. 1 with the front cover and gear box cover removed.
Figure 4:
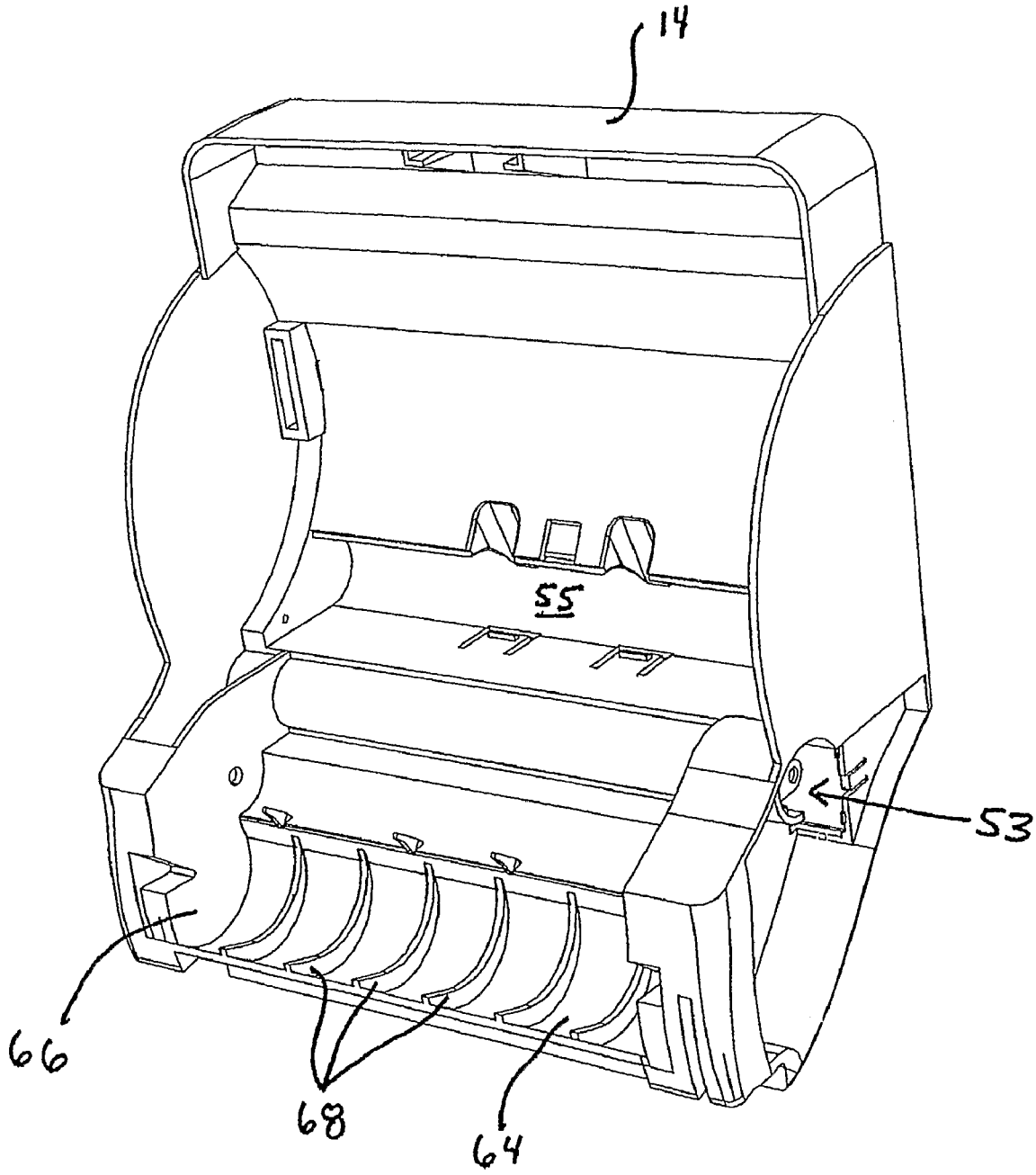
FIG. 4 is a perspective view of the rear housing of the embodiment of FIG. 1.
Figure 9:
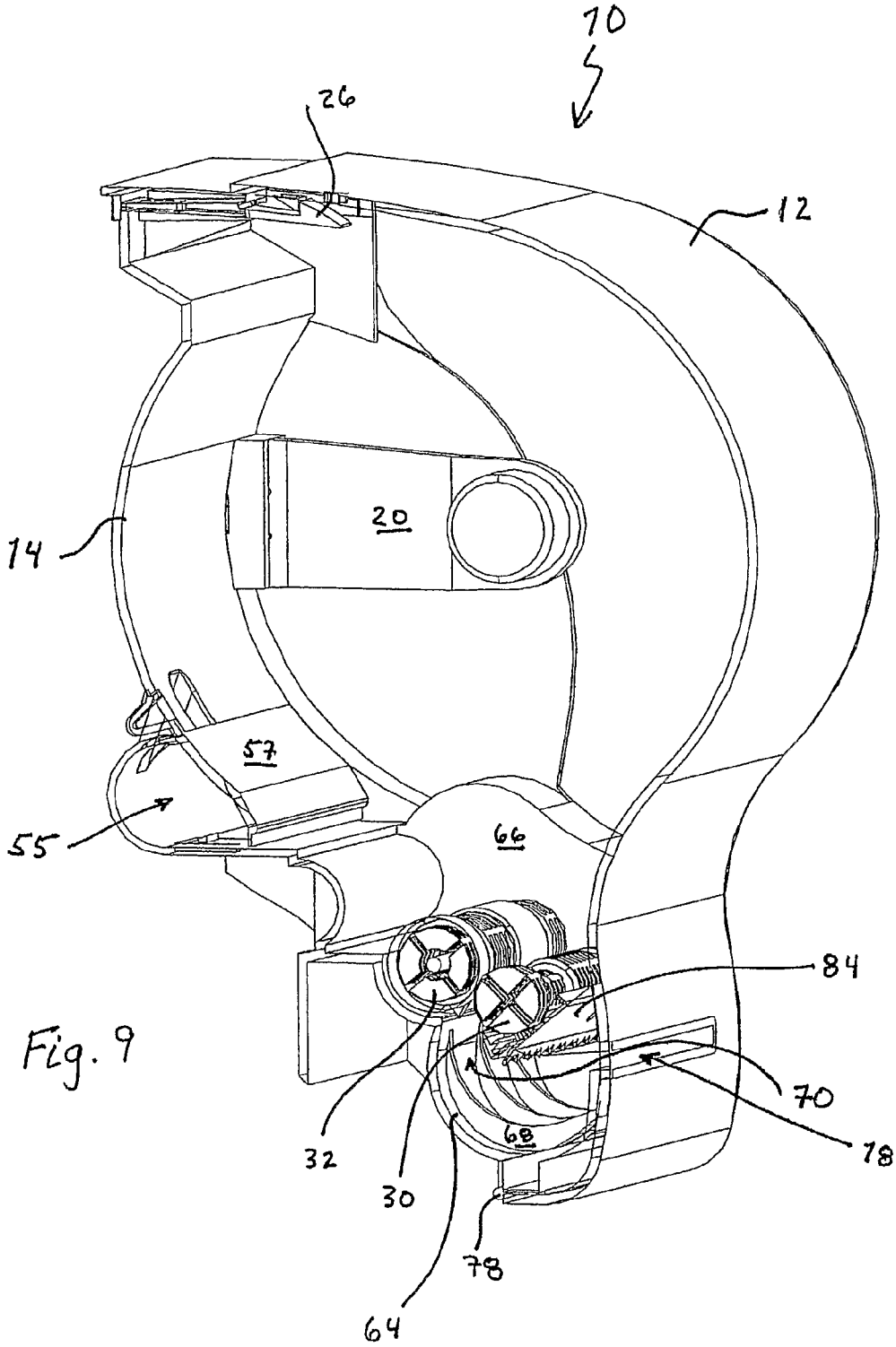
FIG. 9 is a perspective cross-sectional view of the dispenser of FIG. 1 taken along line 9-9.

As best seen in FIGS. 3, 4 and 9, when paper is fed between the idler roller 30 and drive roller 32, it moves into a throat area 70 defined by the two rollers, a bottom portion 64 of the rear housing 14, a side portion 66 of the rear housing 14, a plurality of ribs 68 and a throat cover 72. The throat cover 72 has a top portion 74 upon which a fixed cutting blade 84 and the bearing blocks 34 are preferably supported. It also has a front portion 75 that defines the slot mouth 18. Preferably slot mouth 18 is configured to be only slightly wider than the sheet material being dispensed. Similarly, the slot mouth 18 is preferably very narrow in height, generally less than the width of human finger.

Preferably, the present invention also includes a mechanical cover switch 76 that is used to prevent the drive mechanism from being activated when the front cover 12 is open. More particularly, when the front cover 12 is moved to an open position, by rotating about the center line of hinge 78, the cover switch 76 interacts with trip lever 56 to activate the switch 60 and thereby preclude the activation of the drive mechanism. The configuration of the mechanical switch 76, described herein results in a cost savings over various prior art devices since the electrical switch 60, by virtue of this approach, is able to perform the dual function of precluding activation of the drive mechanism when the cover is open and causing activation of the drive mechanism when the trigger arm 54 completes a cycle from its first position to its second position and back again. A sensor, button or other activation device (not shown) is present so that when the cover of the dispenser is open the drive mechanism can be selectively activated to facilitate paper loading and threading.

In another embodiment of the present invention, a dispenser substantially as shown in FIGS. 1-9, includes an infrared proximity sensor 100. The sensor 100 is used as an alternative to the trigger arm 54 to cause the dispenser to automatically feed a length of sheet material. In other words, instead of the tensioning of a previously fed length of sheet material moving the trigger arm 54 from its first to its second position causing the feeding of a subsequent length of sheet material, it is the interruption of the infrared field that causes the dispenser to feed another length of sheet material. Thus, a dispenser in accordance with the present invention can be configured with both a sensor and a trigger arm so that it is switchable between either mode of operation, or with just a sensor or just a trigger arm.

In use, the dispenser of the present invention is first loaded with a roll of paper or other sheet material (not shown). Assuming the housing is closed, this is accomplished by disengaging the latch mechanism 24 and opening the front cover 12 by rotating it about the hinge 78. The roll supports 20 are separated and the roll of sheet material fit thereon. The end of the sheet material is then threaded between the idler roller 30 and the drive roller 32 and the front cover 12 closed. When the cover is closed, a length of sheet material is automatically fed into the throat area 70 and through the slot mouth 18. Preferably that first length of sheet material is then torn off. If the dispenser is operating in trigger arm mode (or is only equipped with a trigger arm), another length of sheet material will be immediately fed as the tensioning and/or tearing of the paper will move the trigger arm from its first position to its second position and back again. When the trigger arm moves to its second position, it acts upon trip lever 56 which, in turn, tensions leaf spring 58. When leaf spring 58 is tensioned, it activates switch 60 on the circuit board 52. Upon release of the trigger arm back to its first (rest position) the switch 60 opens which sends a signal to motor 50 to rotate an amount sufficient to feed a length of sheet material through the slot mouth 18. As motor 50 rotates, the encoder 62 also rotates to measure the amount of sheet material being fed. The motor 50 also rotates encoder gear 46, which in turn, rotates cluster gear 44, which, in turn, rotates driver gear 42. Driver gear 42 is connected to drive roller 32, so that as it rotates, driver roller 32 also rotates thereby forcing sheet material between it and idler roller 30 such that sheet material travels through the throat area 70 and through the slot mouth 18.

Figures 17, 18:
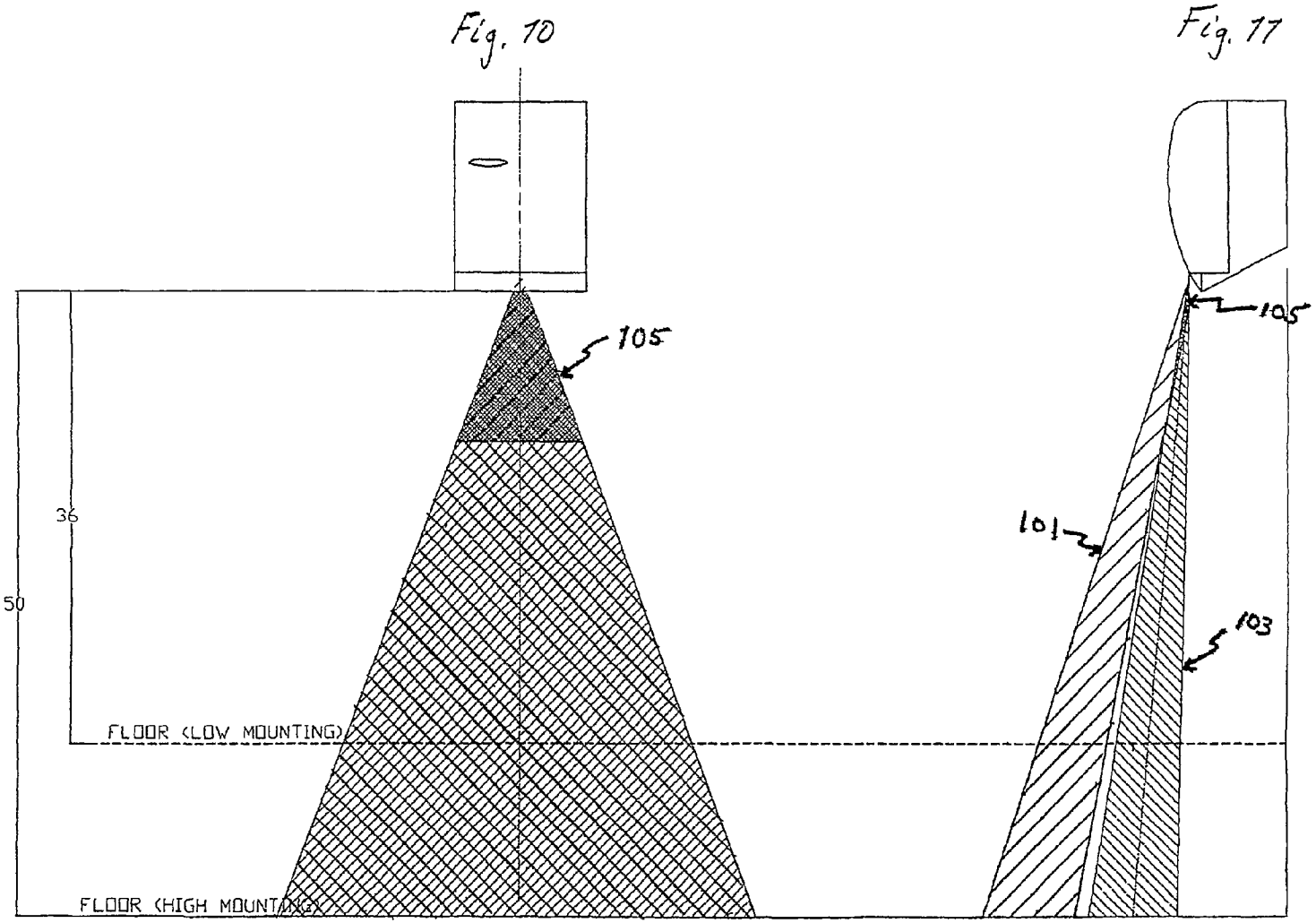
FIG. 17 is perspective view of the embodiment of FIG. 16 with the front cover removed.
Figure 16:
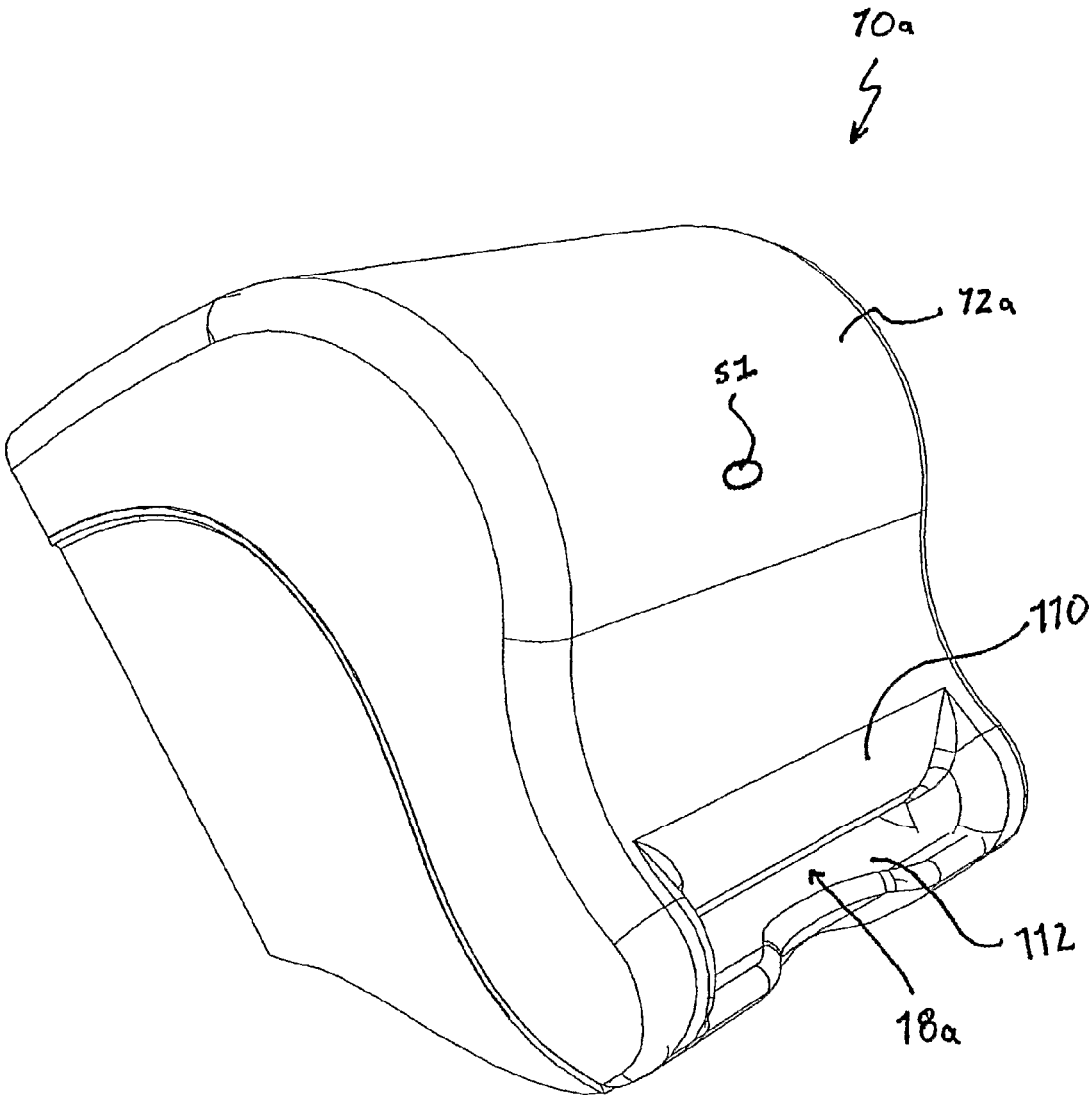
FIG. 16 is perspective view of another embodiment of the present invention.
Figure 17:
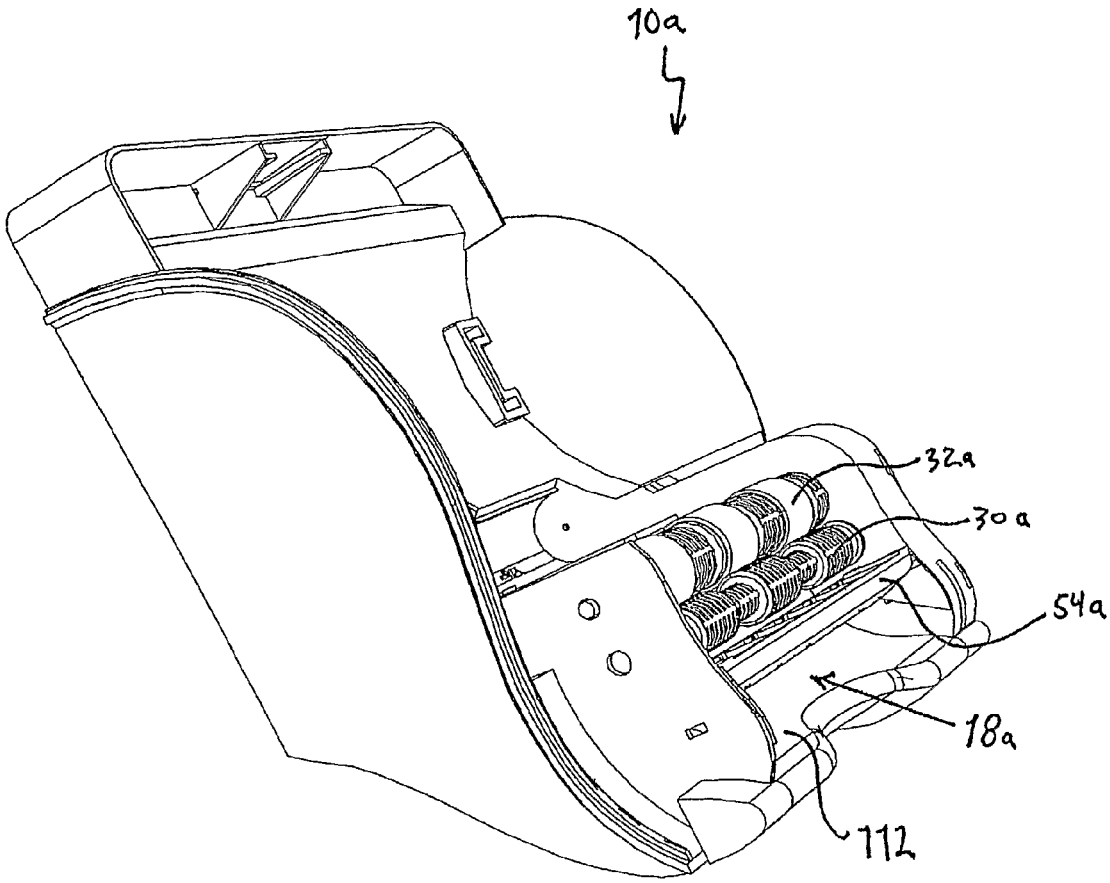

In another embodiment of the present invention, shown in FIGS. 16 and 17, the mouth 18*a* of a sheet material dispenser 10*a* is constructed so that the roof of the mouth 18*a* is essentially eliminated, bringing the dispensing area back to adjacent the point at which the sheet material exits from between the drive roller 32*a* and idler roller 30*a*. More specifically, structure 110, appears as an extension of the cover 12*a* as it curves inwardly toward the drive and idler rollers 30*a* and 32*a*. This structure 110, together with floor portion 112, defines the wide mouth 18*a* through and into which sheet material is dispensed. Because the wide mouth 18*a* is juxtaposed very closely to the drive and idler rollers 30*a* and 32*a* and opens up immediately with no roof portion, jamming does not occur since the paper is available for user access immediately upon exiting from the pinch point. Moreover, since the mouth 18*a* still retains its floor structure 112, and since the cutting blade (not shown) (and trigger arm 54*a* if the dispenser 10*a* is an automatic dispenser without a sensor) is positioned so that any outward or upward pull on the paper results in the paper tearing or additional paper being fed in a predetermined manner.

If the dispenser of the various embodiments of the present invention is operating in sensor mode (or is only equipped with a sensor), the tearing of the length of sheet material originally fed when the front cover 12 (or 12*a*) is closed leaves the dispenser in full operating mode. The dispenser is maintained in this manner until an object is properly sensed by the sensor. Generally, this would be a hand reaching for the slot mouth 18 or wide mouth 18*a*. At that point, a signal is sent to the controller, which, in turn sends a signal to the motor 50 to begin rotating to feed a length of sheet material. From that point on, the dispensing operation is the same as that described with respect to the trigger arm mode.

Figure 12:
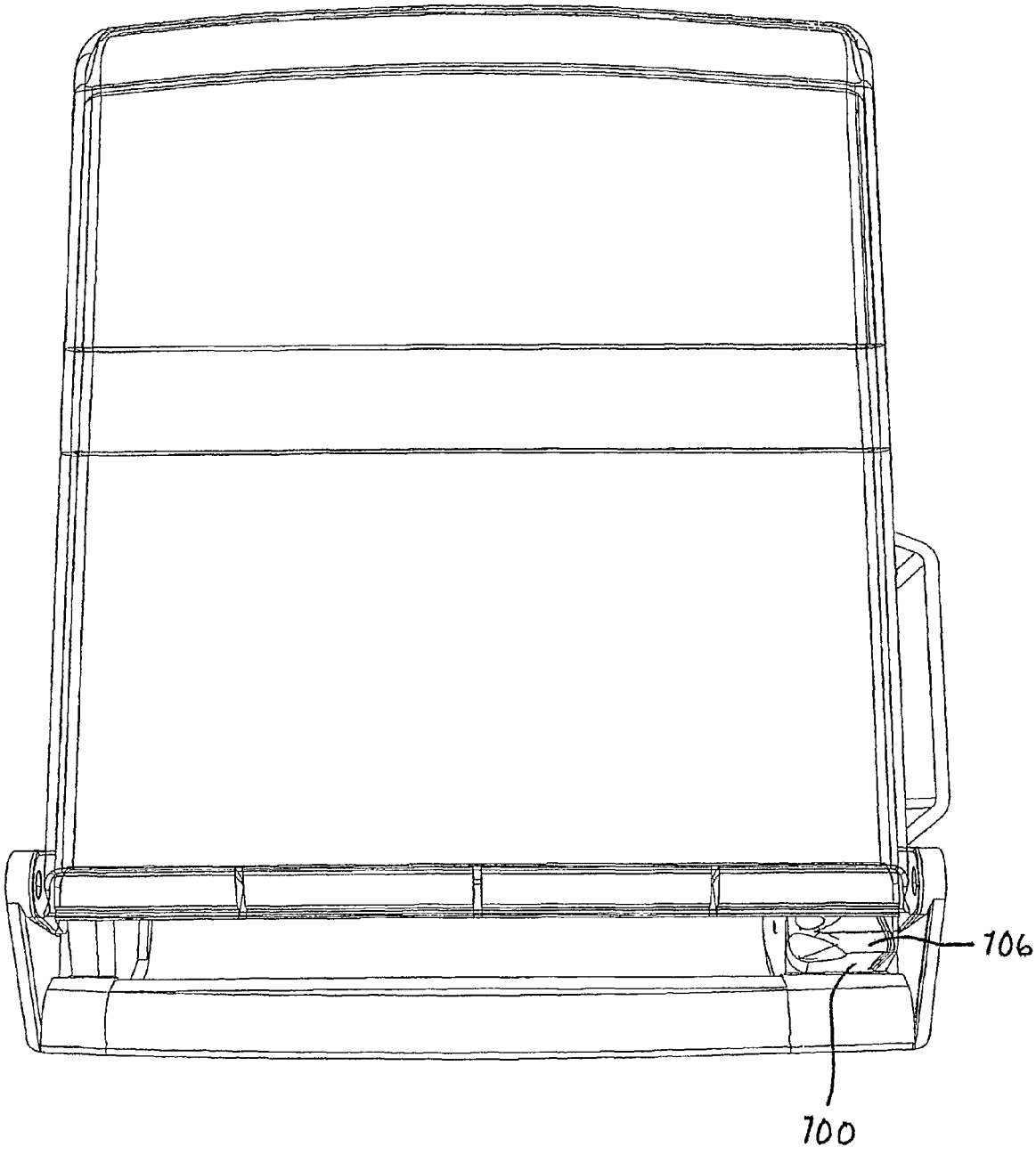
FIG. 12 is a bottom front view of a dispenser fitted with a sensor in accordance with one embodiment of the present invention.
Figure 13:
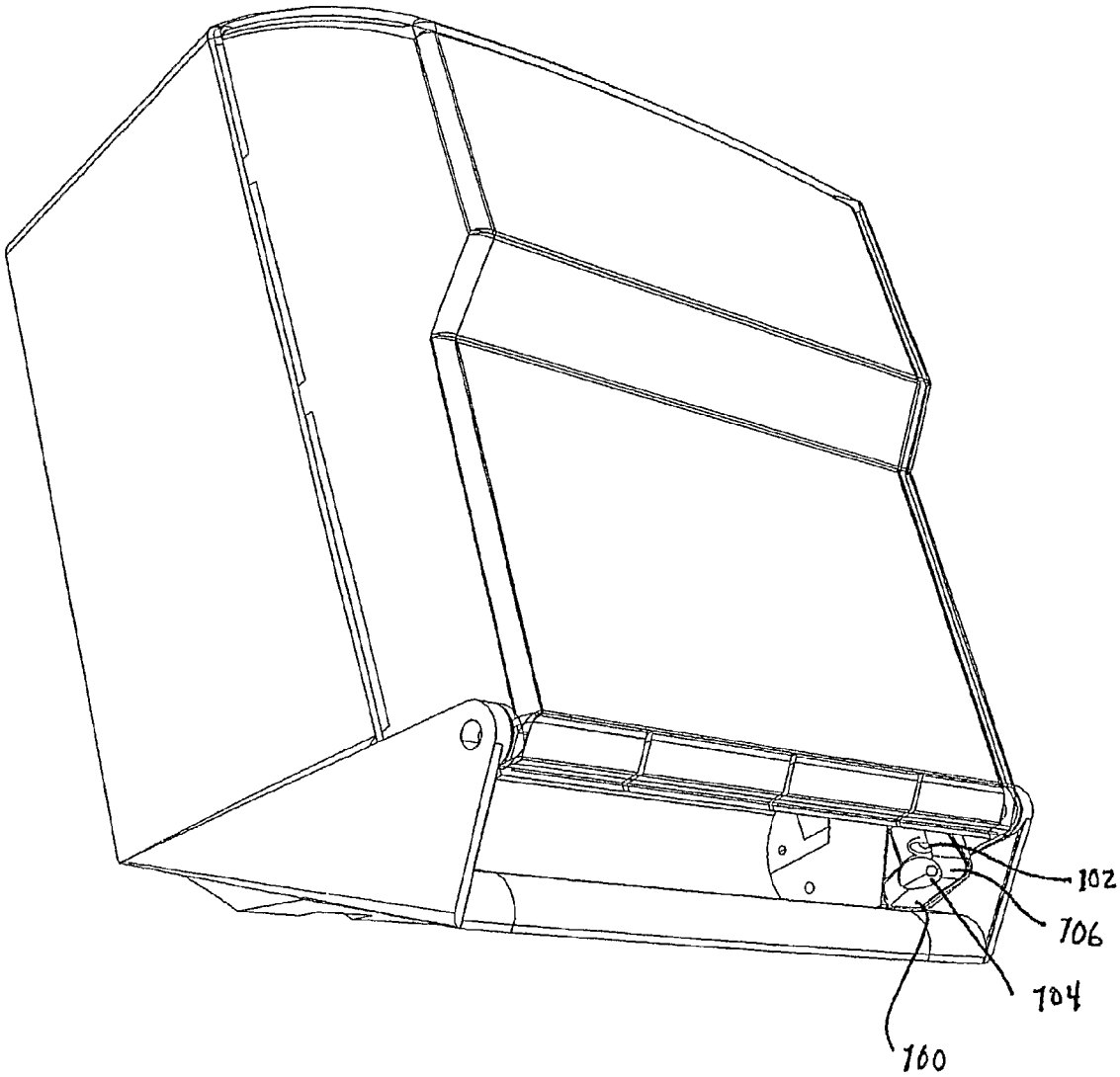
FIG. 13 is a bottom-front-side perspective view of the device shown in FIG. 12.

Referring to FIGS. 12 and 13, the sensor 100 of one embodiment of the present invention includes an IR emitter 102 and an IR receiver 104. Preferably, to make the sensor low cost, the emitter and receiver can be adapted from common IR-remote control devices used to control home video and audio electronics. The sensor 100 is coupled to the controller located on the circuit board 52. As such, the sensor 100 is controlled by and sends signals to the controller to implement the sensing process, to trigger the dispensing of sheet material when appropriate, track false positives, track usage and changes in functionality.

The sensor 100 operates by detecting and processing reflected light transmitted from a standard IR emitter output in the form of a pulsed carrier wave, preferably but not necessarily a 37 kHz carrier wave. Any commercially available IR emitter may be used in constructing the sensor. However, the IR emitter is preferably a Fairchild QED234 emitter. The IR transmission from the emitter is reflected by an object and detected by a receiver module. The IR receiver module provides all the necessary IR detection and signal processing circuits integrated into one package. Preferably, the receiver module is a consumer remote control receiver module used in common consumer electronic products. These modules are produced by several manufacturers including Lite-On, Vishay, Panasonic, Agilent, Rohm, Sharp and others. The IR receiver module is preferably a Sharp GP1UD262K series receiver module.

When an object enters the sensing area, the sensor is activated. When the sensor is employed in a paper towel dispenser, this configuration provides an intuitive interface between the user and dispenser by anticipating the user's desire to obtain a towel. As the user reaches for the paper towel dispenser, the user's hand enters the sensing area and activates the sensors.

The sensor 100 of the present invention preferably has two states, a quiescent state and an active state. In the quiescent state, the sensor pulses at a rate fast enough to detect an approaching hand, but not fast enough to discern it from noise and minimize false positives and slow enough to reduce the sensor's power consumption. Preferably this pulse rate is between 0.1 milliseconds and 1 second, most preferably approximately 18 milliseconds (ms), although the rate is randomized to reject noise (e.g., fluorescent lights, other washroom sensors) and avoid interference with other identical sensors that may be present in the same facility.

When the sensor, in its quiescent state, detects what may be the presence of hand or other object, it immediately moves to its active state and begins pulsing (sampling) comparatively quickly, preferably between 0.1 milliseconds and 1 second, most preferably on the order of 1-2 ms, in a randomized manner. If the faster pulsing confirms the presence of a proper object within the sensing area, the controller on the circuit board 52 sends a signal causing the motor to turn and feed a length of sheet material. If the faster pulsing fails to confirm the presence of a proper object, for example if someone is walking by and just briefly crosses the active sensing area, the sensor will return to its quiescent state. This particular sensor design, by virtue of its high signal to noise ratio and low power consumption, provides additional advantages over many prior sensors because it doesn't interfere with other sensors that may be present in a given location.

The sensor 100 preferably includes a molded enclosure 106 that at least partially directs and shapes the IR light from the emitter into a desired pattern. (Adjusting the strength of the emitter signal (the field strength) or a lens can be used to assist in shaping the IR light into a desired pattern). The molded enclosure is preferable a polymer material that is preferably both opaque to and absorptive of 940 nm IR light and ambient light. This direction and shaping, coupled with the chosen emitter's inherent directivity characteristics (i.e., relative radiant intensity pattern) and the selective adjustment of power to the emitter, results in a predictable and optimized active sensing area.

However, it is not the emitter alone that defines the sensing area. The IR receiver (or detector) also plays a significant role. More specifically, the detector itself has a detector area or pattern that is inherent in its characteristics. Thus, the area of convergence of the emitter pattern and detector pattern define the ultimate active sensing area. While not generally necessary where the emitter pattern is tightly controlled, the detector pattern can also be shaped by similar means to further define or more tightly control the active sensing area. For example, as shown in FIGS. 10 and 11, if the sensor 100 were mounted on the bottom in the center of a dispenser, a pattern such as that shown might be the result. As shown in simplified two dimensional form in FIGS. 10 and 11, the IR emitter would emit a substantially conical beam 101 directed downwardly and slightly outwardly. The detector would detect interruptions in the IR field (actually reflections back to the detector) in a similar substantially conical area 103 directed downwardly and more outwardly than the emitter beam. The intersection between these two patterns would then constitute the active sensing area 105. Of course, the emitter pattern and the detector pattern could be swapped so that the emitter pattern was more outward than the detector pattern and the same active sensing area achieved.

The sensor need not be mounted in the center or the bottom of the dispenser in order to function in accordance with the present invention. In fact, for the dispenser of FIG. 1, mounting the sensor as shown in FIGS. 10 and 11, would not be optimal. Because of the slot mouth 18, and the manner in which the sheet material is dispensed to a user (i.e., up and/or out as in an automatic teller machine as opposed to the more traditional downward dispensing), a user would be less likely to seek to have paper dispensed by placing his or her hands below the dispenser. Instead, a user would most likely reach toward the slot mouth 18. This configuration thus leads to at least four possible sensor locations and configurations.

The first potential sensor location is on, in or behind the front cover 10 where the cover bulges outwardly to accommodate a roll of sheet material (this location is designated as S1 in FIGS. 1 and 17). By placing the sensor in this location, the active sensing area can be shaped so that it is downward from the S1 position, covering a predetermined area above and below the slot mouth 18. The shaped field would also extend a predetermined distance horizontally from and away from the slot mouth 18 or wide mouth 18*a* so that a user's hand, approaching the mouth, would trigger the dispensing of paper.

The second and third potential sensor locations are within the throat area 70. Preferably, the emitter and detector would be able to sense directly through the slot mouth 18 or throughout the wide mouth 18*a*. However, this is not a requirement. It has been determined that the IR sensor of the present invention can function through most appropriate plastic materials used in manufacturing sheet material dispensers, regardless of their visual transparency. Thus, while power requirements may be less if the sensor can function directly through the slot mouth, it is not necessary to achieve the appropriate functionality of the sensor.

Figure 15:
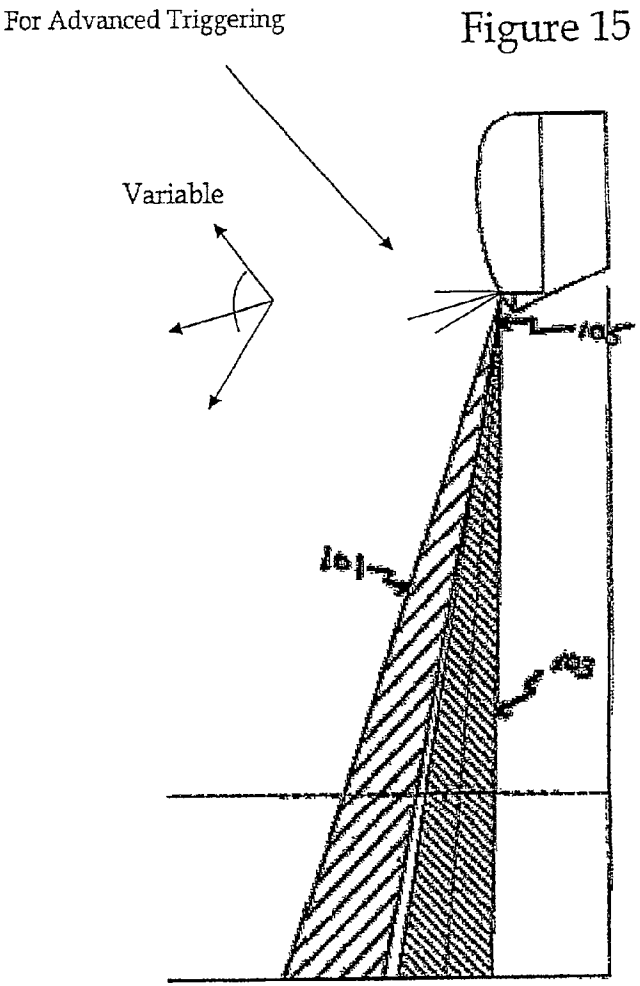
FIG. 15 is a side view of the detector and emitter pattern as shown in FIG. 14.
Figure 14:
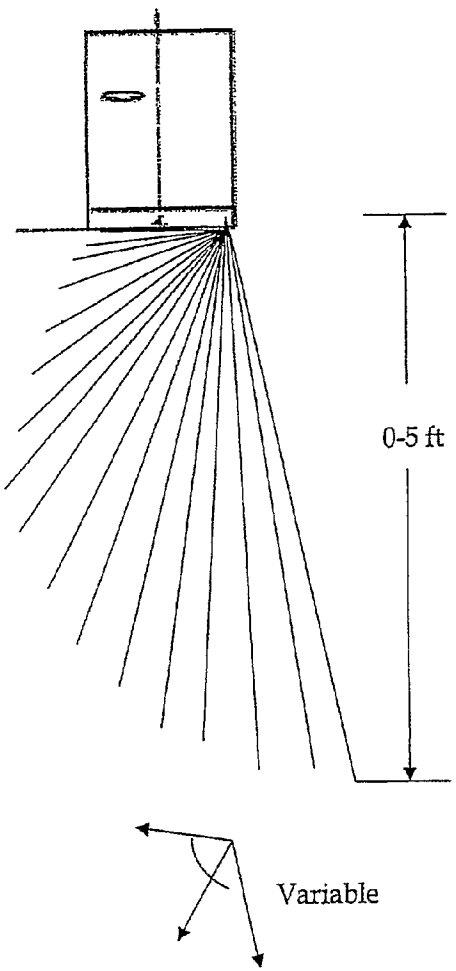
FIG. 14 is a front view of a detector and emitter pattern in a simplified two dimensional form.

Placing the sensor in the throat area 70 also has the potential effect of minimizing the amount of power required for the sensor since the active sensing field is very close to the sensor itself. However, this also means that the sensor must be capable of providing a fairly wide pattern within a very short distance. Within the throat area 70, the dispenser could be mounted in the middle or to the side. As shown in FIGS. 12 and 13, the placement of the sensor on the side closest to the gear assembly 45 is advantageous because it places the sensor close to its power source and the controller. However, such a location means that it is more difficult to achieve a shaped sensing area that completely covers the desired sensing area. More specifically, because the width of the IR beam increases as it moves from emitter (and because the area of detection widens as it moves from the detector), the immediate area around the sensor (i.e., the left side of the dispenser) would have a somewhat narrower sensing area than would be the case if the sensor were mounted in the middle of the throat area 70. In either case, the shaped sensing area would extend in front of and below the slot mouth 18 or wide mouth 18*a*. See FIGS. 14 and 15. Preferably, the shaped sensing area would also extend somewhat above the slot mouth 18 or wide mouth 18*a* as well. However, perhaps the most important factor in shaping the sensing area is to ensure that the outward reach of the sensing area is minimized. Otherwise, casual passersby will accidentally trigger the dispensing of sheet material.

The fourth potential sensor location is below the slot mouth, either in the throat area 70 or on the bottom of the dispenser 10. In such case, the shaped sensing area would be above and outward from the sensor. There would be no downward component of the emitter or detector fields. The sensing area would extend below, above and in front of the slot mouth 18 or wide mouth 18*a*.

In all cases, the sensing area is preferably three dimensional. In one preferred embodiment, both the emitter field and the detector field are conical in shape. This renders the convergence or active sensing area as something akin to an elliptical cone, a hyperbolic cone or an asymmetrical elliptical cone, depending on the placement of the sensor with respect to the dispenser. The exact shape and dimensions of the convergence area, however, can be modified by sensor placement, the amount of power applied to the emitter, the shape of the housing used to shape the emitter (or detector) field and the inherent directivity characteristics of the emitter to match the preferred shape of the active sensor area for a given dispenser.

As described above, the sensor is configured as a unit with the detector and emitter located substantially in one location. However, this need not be the case, The emitter and detector can be separated, for example the emitter located in position S1 and the detector located on the bottom the dispenser as described with respect to the fourth potential location. While this configuration increases costs and complexity, the sensing can still be appropriately shaped by the combination of elements described above.

While the sensor and shaped sensing area have principally been described in connection with the dispenser embodiment depicted in FIG. 1, the sensor and shaped sensing area of the present invention can be employed in connection with prior art automatic dispensers to improve and/or enhance such dispensers' overall functionality.

Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter set forth herein.

The invention claimed is:

1. A dispenser comprising:

a support for a roll of web material;

a drive roller cooperating with an idler roller to feed web material supported by said roll support;

a mouth through which the web material is dispensed;

a motor for selectively driving said drive roller to feed a predetermined amount of web material through said mouth; and a sensor generating a sensing field for selectively activating said motor in response to an incursion into said sensing field, wherein said sensor comprises an infrared emitter and receiver and wherein said sensor has two states, a quiescent state and an active state, wherein in the quiescent state the sensor pulsates at a first non-zero frequency and in the active state the sensor pulsates at a second non-zero frequency that is at a faster rate than the first non-zero frequency.

2. A dispenser according to claim 1, further comprising a trigger arm for selectively activating said motor when said trigger moves from a first to second position.

3. A dispenser according to claim 2, wherein said trigger arm moves from said first to said second position when the web material is tensioned by a user.

4. A dispenser according to claim 1, wherein said sensing field is shaped so as to extend in front of and below said mouth.

5. A dispenser according to claim 4, wherein the outward reach of said sensing field is minimized to avoid accidental activation of said motor.

6. A dispenser according to claim 1, wherein when said sensor is in said quiescent state, it pulses at a rate of between about 0.1 milliseconds to about 1 second.

7. A dispenser according to claim 6, wherein when said sensor is in said quiescent state it pulses at a rate of about 18 milliseconds.

8. A dispenser according to claim 1, wherein when said sensor is in said active state, it pulses at a rate of between about 0.1 milliseconds to about 1 second in a randomized manner.

9. A dispenser according to claim 8, wherein when said sensor is in said active state it pulses at a rate of between about 1 to 2 milliseconds in a randomized manner.

10. A dispenser according to claim 9, wherein if said sensor is in said active state and does not confirm the presence of an incursion into said sensing field within a predetermined time, said sensor moves to said quiescent state.

11. A dispenser according to claim 1, wherein said sensor is mounted in a shaped enclosure that at least partially shapes the sensing field.

12. A dispenser according to claim 1, wherein said sensor includes a lens juxtaposed with respect to said emitter that at least partially shapes the sensing field.

13. A dispenser according to claim 1, further comprising a front cover portion and wherein said sensor is mounted in or behind said front cover portion.

14. A dispenser according to claim 13, wherein said sensor is located proximate a plane extending from the longitudinal axis of said front cover portion.

15. A dispenser according to claim 1, wherein said sensor is located proximate said mouth.

16. A dispenser according to claim 15, wherein said sensor is located proximate a plane extending from the longitudinal axis of said mouth.

17. A dispenser according to claim 15, wherein said sensor is located proximate one side of said mouth.

18. A dispenser according to claim 1, wherein said sensor is located below said mouth.

19. A dispenser comprising:

a support for a roll of web material;

a drive roller cooperating with an idler roller to feed web material supported by said roll support;

a mouth through which the web material is dispensed;

a motor for selectively driving said drive roller to feed a predetermined amount of web material through said mouth; and a sensor generating a generally conical shaped sensing field for selectively activating said motor in response to an incursion into said sensing field, wherein said sensor comprises an infrared emitter and receiver, and wherein the sensor is pulsed at a first non-zero pulse rate when an object is not detected within the sensing field and is pulsed at a second non-zero pulse rate when an object is detected within the sensing field, wherein the second non-zero pulse rate is at a faster frequency than the first non-zero pulse rate.

20. A dispenser according to claim 19, further comprising a molded sensor enclosure enclosing the sensor and configured to at least partially direct and shape infrared emissions of the infrared emitter.

21. A dispenser according to claim 20, wherein the molded sensor enclosure is composed of a material that is substantially opaque to and substantially absorptive of 940 nm infrared light and ambient light.

22. A dispenser according to claim 19, wherein the infrared emitter emits a selectively variable infrared signal for selectively tuning the sensing field.

23. A dispenser comprising:

a support for a roll of web material;

a drive roller cooperating with an idler roller to feed web material supported by said roll support;

a mouth through which the web material is dispensed;

a motor for selectively driving said drive roller to feed a predetermined amount of web material through said mouth; and a sensor generating a sensing field for selectively activating said motor in response to an incursion into said sensing field, wherein said sensor comprises an infrared emitter and receiver, and wherein said sensor is operable in a quiescent state in which the sensor senses for an object in the sensing field at a first sensing rate and is operable in an active state in which the sensor senses for an object in the sensing field at a second sensing rate faster than the first sensing rate, and wherein the sensor is switched from operating in the quiescent state to the active state upon detection of an object in the sensing field and stays in the active state until an object is no longer detected in the sensing field.

24. A dispenser according to claim 23, wherein said sensing field is shaped so as to extend in front of and below said mouth.

25. A dispenser according to claim 24, wherein the outward reach of said sensing field is minimized to avoid accidental activation of said motor.

26. A dispenser according to claim 23, wherein when said sensor is in said quiescent state, it pulses at a rate of between about 0.1 milliseconds to about 1 second.

27. A dispenser according to claim 26, wherein when said sensor is in said quiescent state it pulses at a rate of about 18 milliseconds.

28. A dispenser according to claim 23, wherein when said sensor is in said active state, it pulses at a rate of between about 0.1 milliseconds to about 1 second in a randomized manner.

29. A dispenser according to claim 28, wherein when said sensor is in said active state it pulses at a rate of between about 1 to 2 milliseconds in a randomized manner.

30. A dispenser according to claim 29, wherein if said sensor is in said active state and does not confirm the presence of an incursion into said sensing field within a predetermined time, said sensor moves to said quiescent state.

31. A dispenser according to claim 23, wherein said sensor is mounted in a shaped enclosure that at least partially shapes the sensing field.

32. A dispenser according to claim 23, wherein said sensor includes a lens juxtaposed with respect to said emitter that at least partially shapes the sensing field.

33. A dispenser according to claim 23, further comprising a front cover portion and wherein said sensor is mounted in or behind said front cover portion.

34. A dispenser according to claim 33 wherein said sensor is located proximate a plane extending from the longitudinal axis of said front cover portion.

35. A dispenser according to claim 23, wherein said sensor is located proximate said mouth.

36. A dispenser according to claim 35, wherein said sensor is located proximate a plane extending from the longitudinal axis of said mouth.

37. A dispenser according to claim 35, wherein said sensor is located proximate one side of said mouth.

38. A dispenser according to claim 23, wherein said sensor is located below said mouth.

* * * * *